US005360061A

United States Patent [19]

Womble

[11] Patent Number: 5,360,061

[45] Date of Patent: Nov. 1, 1994

[54] BLOWOUT PREVENTER WITH TUBING SHEAR RAMS

[76] Inventor: Lee M. Womble, 3403 Saratoga Dr., Houston, Tex. 77088

[21] Appl. No.: 960,690

[22] Filed: Oct. 14, 1992

[51] Int. Cl.[5] ..... E21B 29/08

[52] U.S. Cl. ..... 166/55; 277/129

[58] Field of Search ..... 166/55, 250, 84

[56] References Cited

U.S. PATENT DOCUMENTS

| | | | |
|---|---|---|---|
| 2,919,111 | 12/1959 | Nicolson | 166/55 |
| 3,561,526 | 2/1971 | Williams, Jr. et al. | 166/55 |
| 4,081,027 | 3/1978 | Nguyen | 166/55 |
| 4,132,265 | 1/1979 | Williams, Jr. | 166/55 |
| 4,132,266 | 1/1979 | Randall | 166/55 |
| 4,132,267 | 1/1979 | Jones | 166/55 |
| 4,240,503 | 12/1980 | Holt, Jr. et al. | 166/55 |
| 4,313,496 | 2/1982 | Childs et al. | 166/55 |
| 4,341,264 | 7/1982 | Cox et al. | 166/55 |
| 4,347,898 | 9/1982 | Jones | 166/55 |
| 4,531,585 | 7/1985 | Hansen | 166/297 |
| 4,537,250 | 8/1985 | Troxell | 166/55 |
| 4,646,825 | 3/1987 | Van Winkle | 166/55 |
| 4,923,005 | 5/1990 | Laky et al. | 166/55 |
| 5,199,493 | 4/1993 | Sodder, Jr. | 166/55 |

*Primary Examiner*—Ramon S. Britts

*Assistant Examiner*—Frank S. Tsay

[57] ABSTRACT

An improved shearing blowout preventer having improved shearing rams for shearing a tubing string extending through the bore of the preventer body. The shear rams include a shear ram having an upper shear blade and a ram having a lower shear blade. The upper shear blade includes a flat surface under the blade with a recess therein for a sealing element and a pair of surfaces spaced apart and below the flat surface under the blade and a tapered conical recess in the rear end of the blade to receive the fish that is sheared and to control the shape of the upper end of the sheared fish. The ram with the lower shear blade includes a tapered conical surface in the center portion of the blade and extending below the cutting edge of the blade. This recess coacts with the recess below the upper shear blade to shape the cut fish so that it does not flatten and to maintain a substantial opening in its upper end without exceeding maximum dimension. The shape of the two tapered conical recesses is such that they will receive a variety of sizes of tubing and function to maintain the opening of the upper end of the lower fish while preventing the transverse dimension from exceeding the preselected maximum dimension.

5 Claims, 9 Drawing Sheets

BLOWOUT PREVENTER WITH TUBING SHEAR RAMS

BACKGROUND

The present invention relates to an improved blowout preventer with improved tubing shear rams.

Prior to the present invention blowout preventers have been provided with tubing shear rams, but they were sized to shear a particular size of tubing and they functioned to shear the tubing string so that the upper end of the tubing left in the well bore was flattened and in subsequent operations, in order to be recovered by a fishing operation, had to be cut or otherwise manipulated so that the upper end was open and so that the overshot could properly engage and recover the string.

U.S. Pat. Nos. 4,132,266; 4,132,267; 4,341,264 and 4,531,585 are typical examples of such prior tubing shear rams. The rams flattened, bent and closed the upper end of the tubing string left in the well bore. Additionally, the blowout preventer was provided with shear rams which were sized to shear a particular size tubing but did not always function properly when shearing smaller or larger tubing strings. U.S. Pat. No. 4,081,027 discloses another type of blowout preventer with shear blades, and the upper end of the lower fish is closed by the shearing action as is clearly shown in FIG. 4 of this patent. Further, U.S. Pat. No. 4,240,503 discloses a shearing type of blowout preventer with the sealing after cutting being by a seal strip under the upper blade which, when the blades are closed, is caused by the flow of the elastomer responsive to such closing to move into sealing engagement with the upper surface of the lower blade.

U.S. Pat. No. 4,537,250 discloses a blowout preventer which includes shearing blades with a node or nodes on the lower blade to reduce the shearing force. Also, this patent discloses the use of a concave blade shape to support the string during shearing sufficiently to constrain the string below the upper shear blade as it is sheared to a shape suitable for receiving an overshot type of retrieving tool and to allow flow therein.

SUMMARY

The improved tubing shearing blowout preventer of the present invention includes the usual body with a vertical central bore therethrough and with opposed guideways extending outward from the vertical bore to house the shear rams and any other set of rams which might be desired, such as closing and sealing rams together with the improved tubing shear rams of the present invention. The improved tubing shear rams include an upper shear ram and a lower shear ram which coact when moved into the vertical bore to shear a tubing string positioned in the vertical bore and have the capacity to shear tubing strings of different sizes. Both upper and lower shear rams having a tapered pocket to receive the tubing string therein for shearing and such pockets have a minimum dimension so that the tubing after shearing does not exceed the nominal outside diameter of the original tubing.

In use, the conical recesses in the shear rams can be sized and positioned to coact to engage a tubing extending through the body bore to cause the upper end of tubing after shearing to leave a substantial opening therein of, e.g. a minimum of 30% of the original flow area within the tubing, and to be no larger in its dimension transversely of the rams than the original diameter of the tubing. Consequently, a separate trip is not required to prepare the upper end of the tubing string left in the well bore prior to lowering an overshot to engage the upper end of such sheared tubing string.

An object of the present invention is to provide an improved blowout preventer having improved tubing shear rams which can be used to shear tubing strings of more than one size.

Another object is to provide an improved blowout preventer having improved tubing shear rams which shear a tubing string in such a manner that a separate trip is not required to prepare the upper end of the tubing string left in the well bore prior to lowering an overshot to engage the upper end of such sheared tubing string.

A further object is to provide improved tubing shear rams for a blowout preventer which shear tubing strings of more than one size and which leave the upper end of the sheared tubing string remaining below the shear rams sufficiently rounded and open to allow direct overshot operations without preparing such upper end of the sheared tubing string.

Still a further object of the present invention is to provide an improved blowout preventer with tubing shear rams which requires less rig time for tubing shearing and overshot operations and less inventory of parts for the components of the blowout preventer.

A still further object of the present invention is to provide an improved blowout preventer with tubing shear rams which can shear a wire line extending through the preventer, even when the wire line is not under tension.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
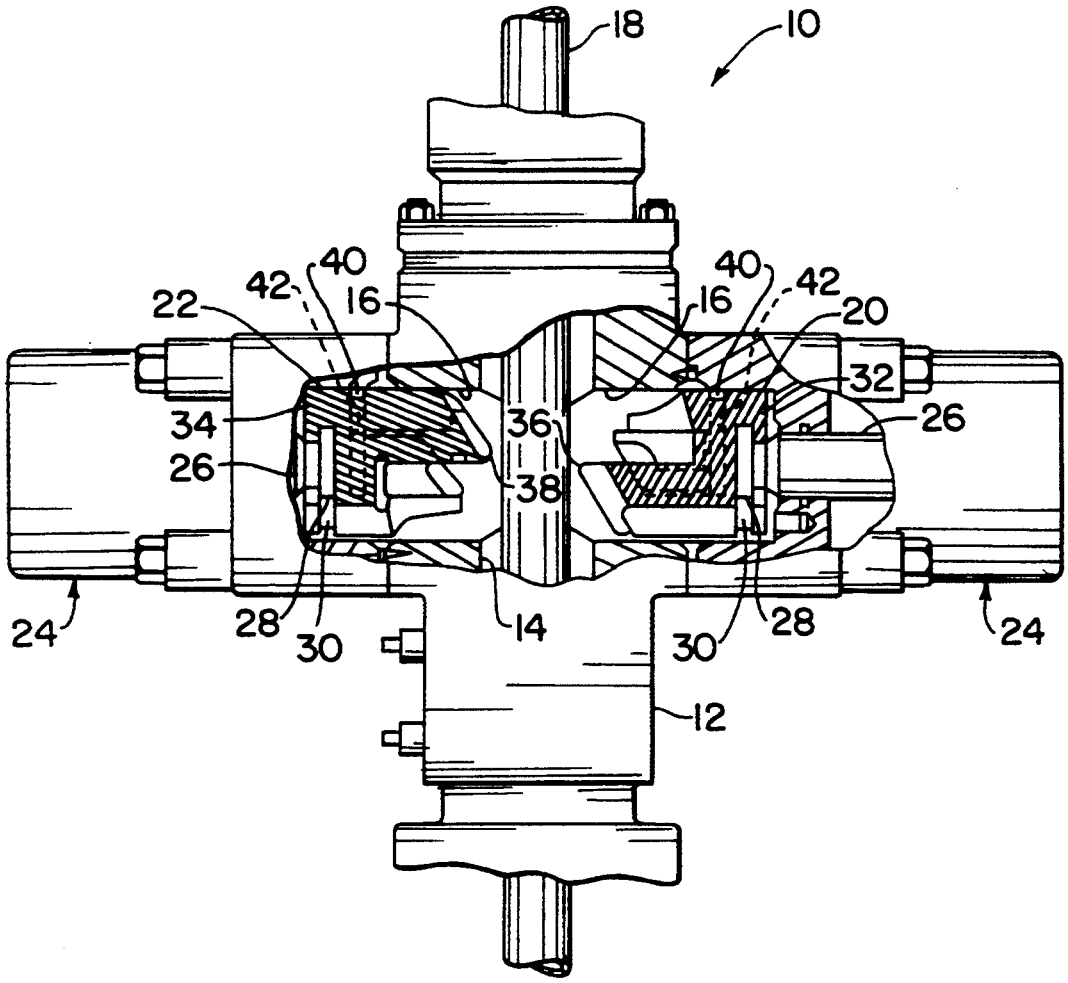
FIG. 1 is a vertical sectional view of a prior art blowout preventer having shearing rams.

Blowout preventer 10 shown in FIG. 1 is a prior art blowout preventer having shearing capacities, such as is disclosed and claimed in U.S. Pat. No. 4,537,250. Blowout preventer 10 includes body 12 having a central bore 14 extending vertically therethrough and ram guideways 16 which are aligned and extend outwardly through body 12 from opposite sides of bore 14. Production tubing string 18 is shown extending through bore 14 in its normal position and with ram assemblies 20 and 22 positioned in their retracted position within guideways 16. Production tubing string 18 is supported below blowout preventer 10 in the normal manner so that when it is sheared it does not drop below the blowout preventer 10. Suitable means 24 is provided for moving ram assemblies 20 and 22 inwardly and outwardly in their respective guideways 16. Such means (not shown in section) includes the usual ram piston which is connected to its ram by connecting rod 26. Flanges 28 on the ends of connecting rod 26 engage in slots 30 in the rear of ram bodies 32 (lower) and 34 (upper) to provide connection of ram assemblies 20 and 22 from their respective moving means 24.

Blowout preventer 10 includes shearing means for the cutting of tubing 18, when it is desirable, such as when there is a threatened well blowout. The cutting of the tubing with the shearing rams closing and sealing the bore 14 after the shearing provides the means for controlling the well and preventing a blowout. Ram assembly 20 shown in the right hand side of the drawing and ram assembly 22 shown in the left hand side of the drawing each include a shear blade. Lower shear blade 36 is integral with (or if hardened blades are desired) is secured to the face of body 32 of ram assembly 22 and upper shear blade 38 is a part of or secured to the face of body 34 of ram assembly 20.

In addition to shear blades 36 and 38, each of ram assemblies 20 and 22 include top seals 40 which are positioned in grooves 42 which extend across the top of ram bodies 32 and 34 from side to side and provide a continuation of side packings on ram bodies 32 and 34. Lower shear blade 36 is integral with ram body 32, has a flat upper surface 44 for engaging and sealing against seal element 46 contained within groove 48 in the lower surface 50 of upper shear blade 38. For additional details of such prior art structure, reference is made to the above mentioned patent.

Figure 2:
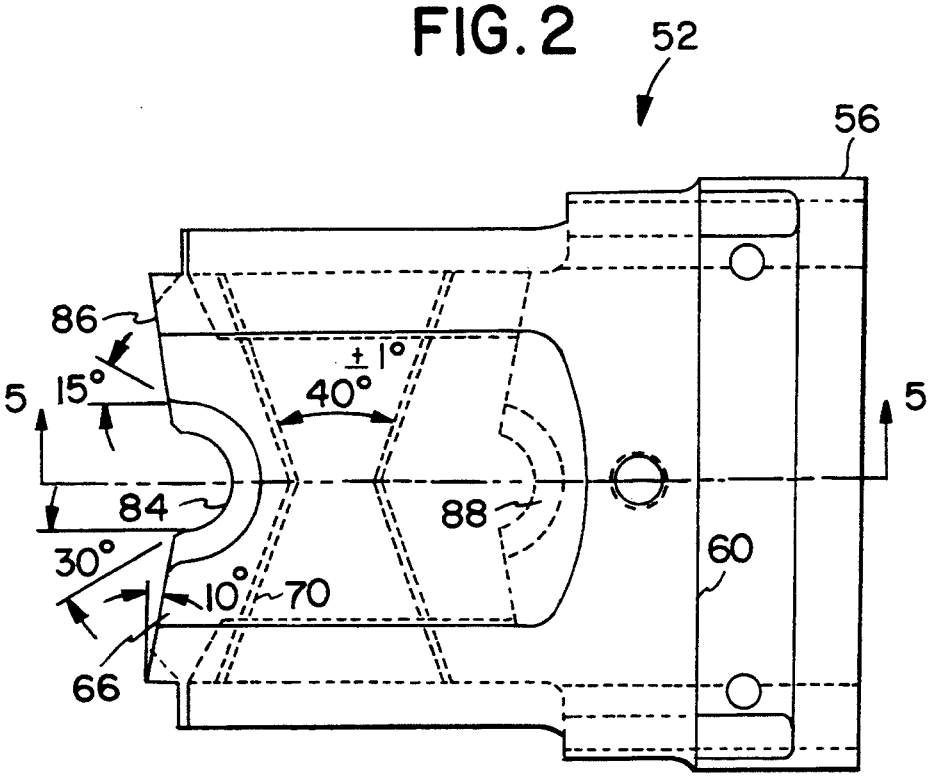
FIG. 2 is a plan view of the improved upper shear ram of the present invention.
Figure 3:
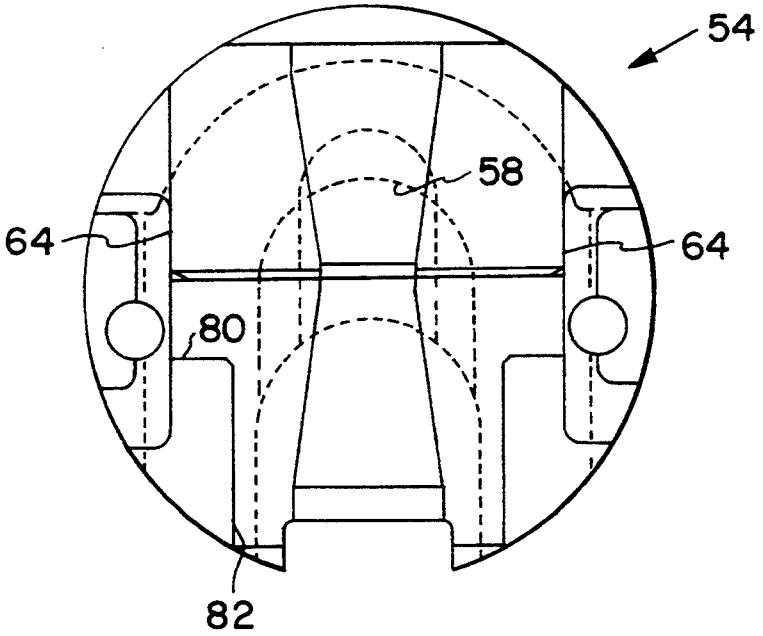
FIG. 3 is a front view of the upper shear ram shown in FIG. 2.
Figure 4:
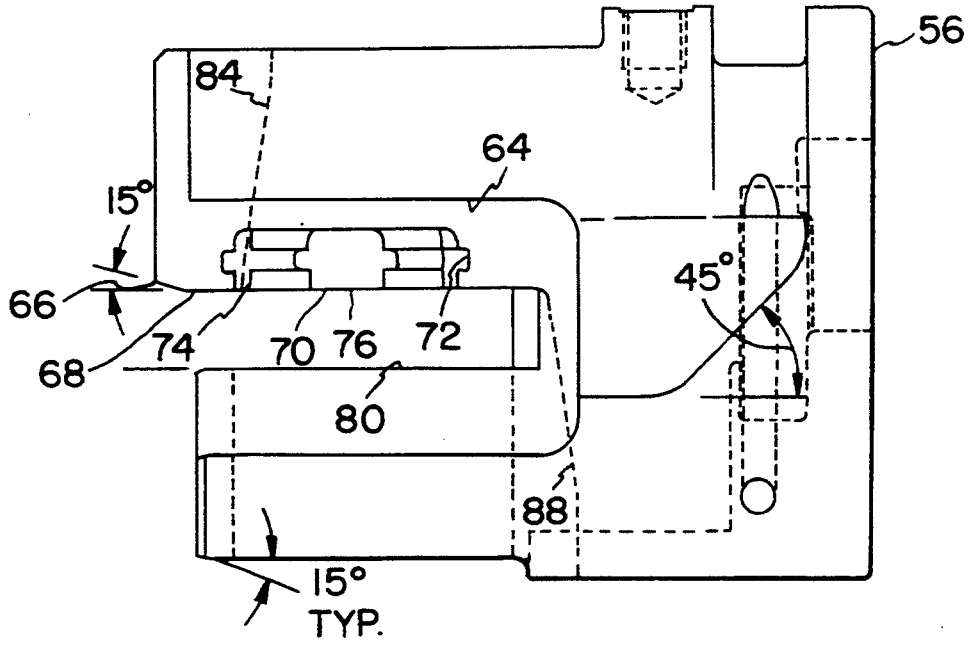
FIG. 4 is a side view of the upper shear ram shown in FIGS. 2 and 3.
Figure 5:
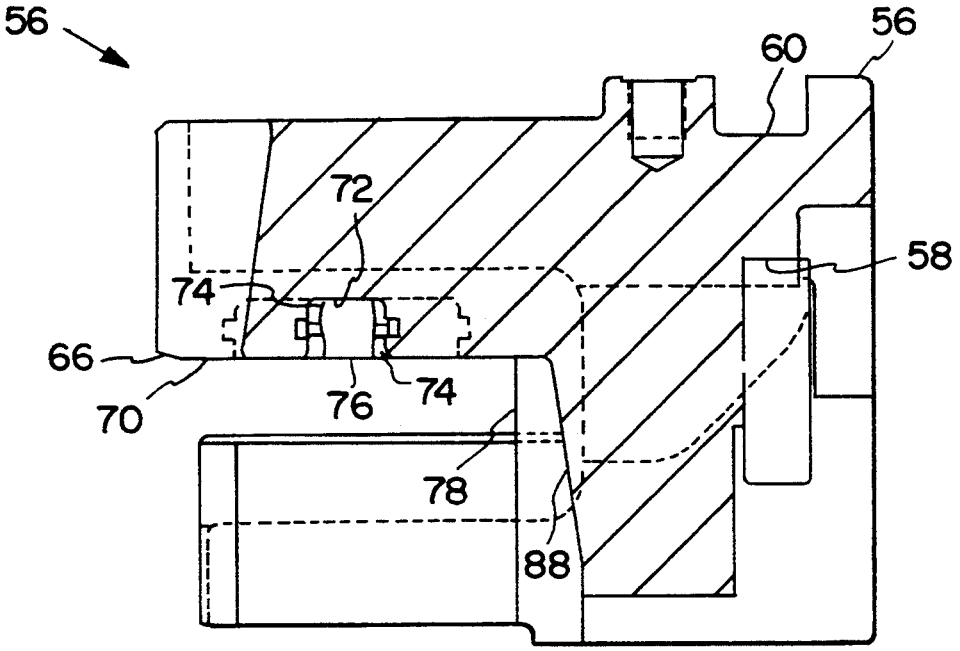
FIG. 5 is a sectional view of the upper shear ram taken along line 5—5 in FIG. 2.

The improved blowout preventer of the present invention may be the same as that shown in FIG. 1 with the improved shearing rams 52 and 54 being substituted for the structure shown in FIG. 1. Such shearing rams 52 and 54 are positioned within the guideways 16 for reciprocation therein to move into bore 14 to close on and shear string 18 which extends through bore 14 in body 12 and to withdraw for bore 14 into guideways 16. Upper shearing ram 52 includes body 56 having rear slot 58 for engagement with connecting rod 26, groove 60 for receiving top seal 40, side recesses 62 for receiving side packers 64 and forwardly extending shearing blade 66 having a cutting edge at its lower portion with flat surface 68 extending rearwardly therefrom. Recess 70 in surface 68 is tapered in a direction to reduce its width as it approaches the center of body 56 as best seen in FIG. 2. Recess 70 is provided with side recesses 72 which are sized to receive and retain metal edges 74 of sealing elements 76. Flat surface 68 ends in wall 78 which extends downward to surface 80 which extends to the front of ram 52 on each side of opening 82 in body 56. The forward portion of upper shear blade 52 includes a central tapered conical recess 84 extending upward and of increasing diameter in the upward direction and a flaring taper 86 extending to each side of blade 66 from the conical recess 84. Conical tapered recess 88 is positioned centrally in ram body 56 as an extension of wall and functions to receive the upper end of a lower string which has been sheared by the rams 52 and 54.

Figure 6:
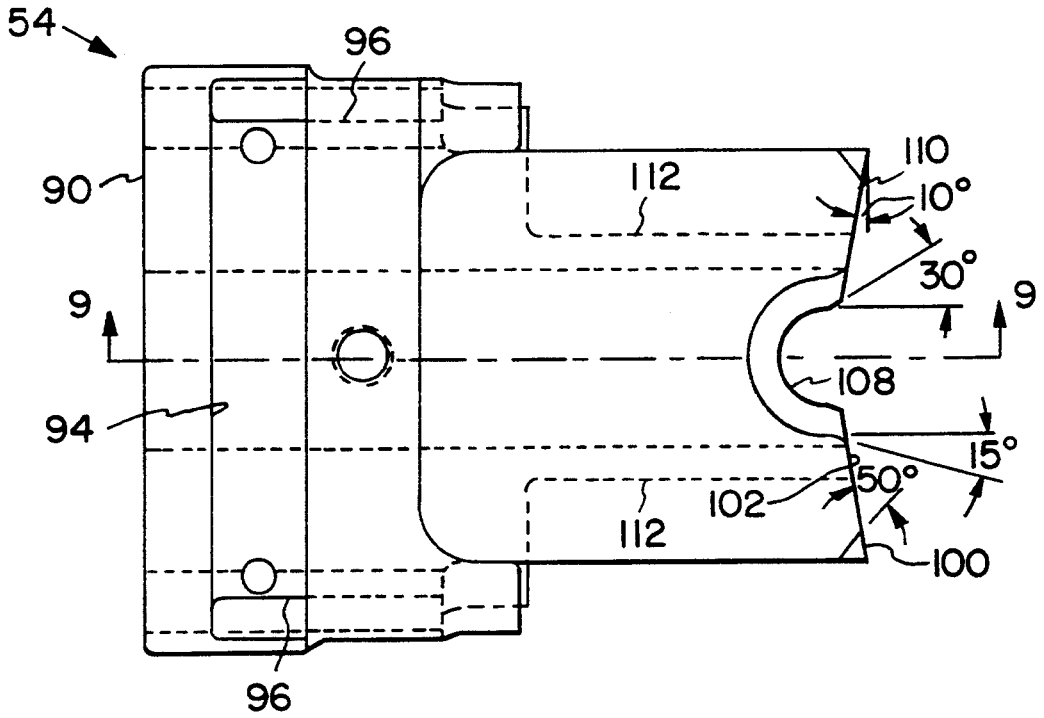
FIG. 6 is a plan view of the improved lower shear ram of the present invention.
Figure 7:
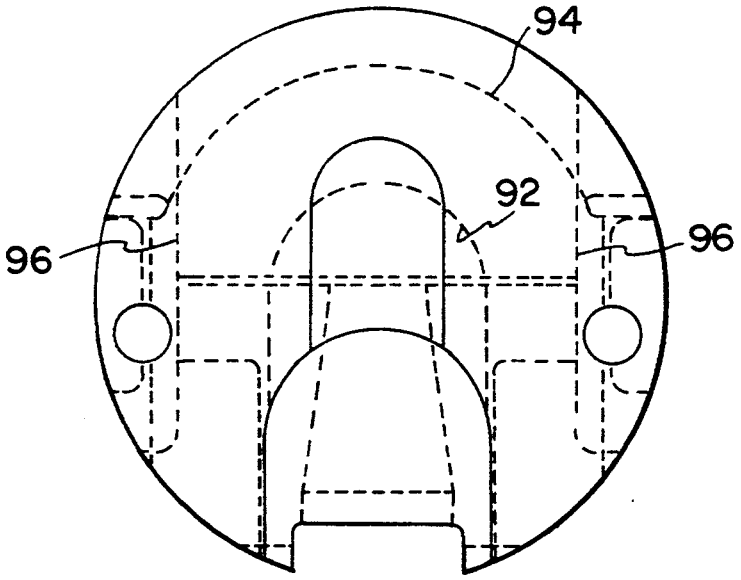
FIG. 7 is a front view of the lower shear ram shown in FIG. 5.
Figure 8:
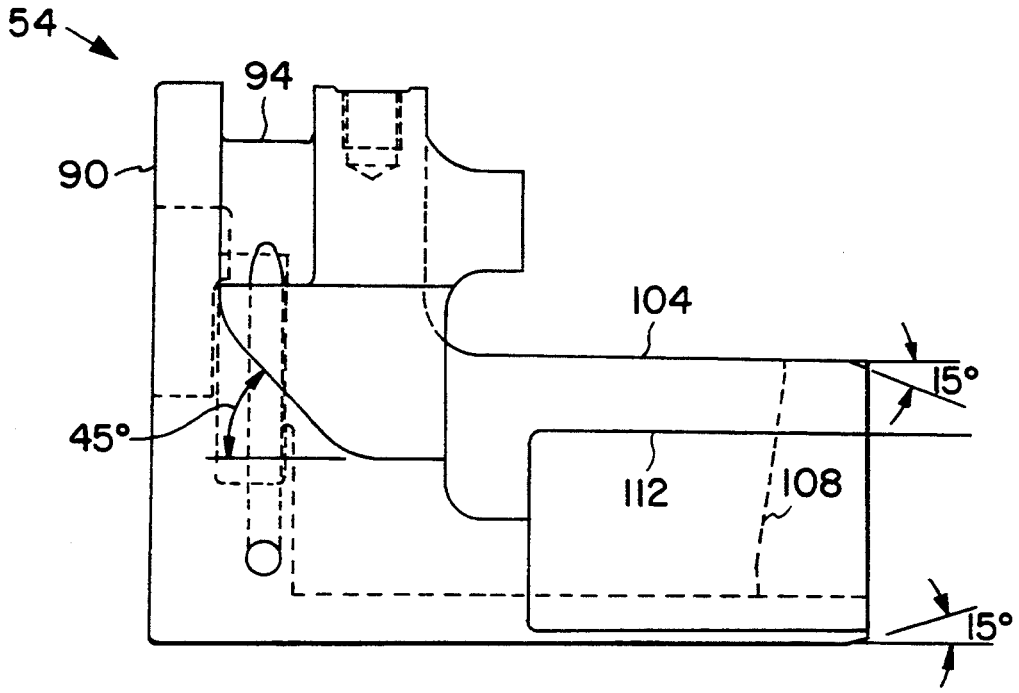
FIG. 8 is a side view of the lower shear ram shown in FIGS. 5 and 6.
Figure 9:
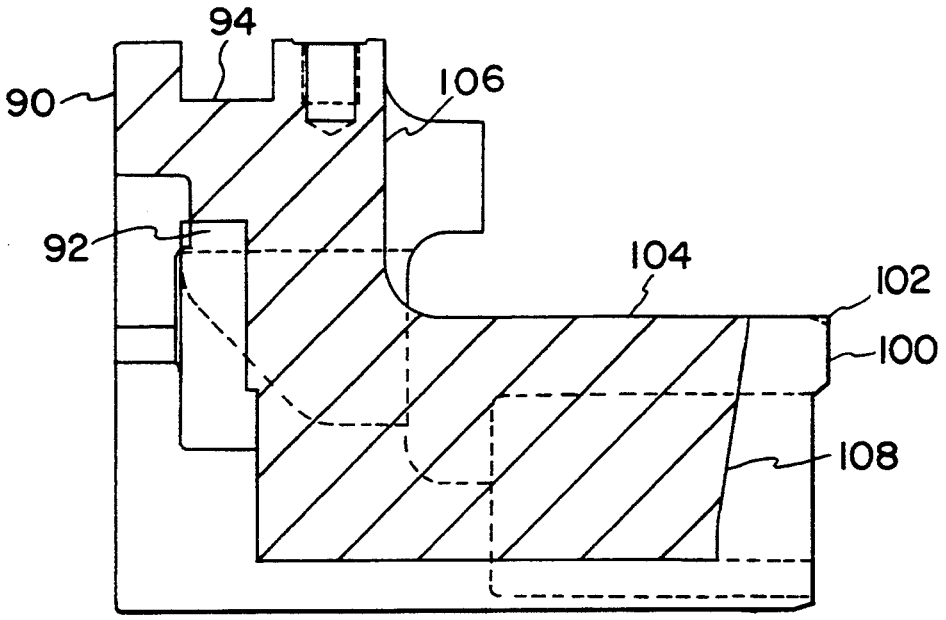
FIG. 9 is a sectional view of the lower shear ram taken along line 9—9 in FIG. 6.
Figure 10A:
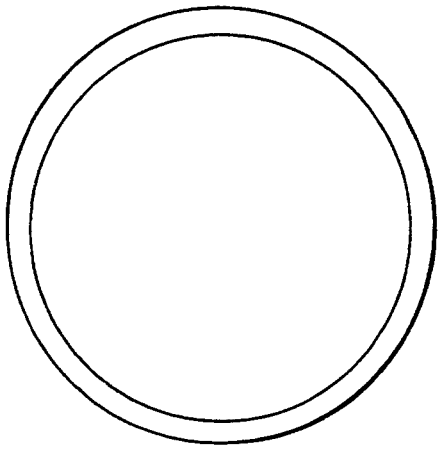
FIG. 10 drawings are top views of the tubing before (FIG. 10A) and after (FIG. 10B) shearing by the improved shearing rams of the present invention.
Figure 10B:
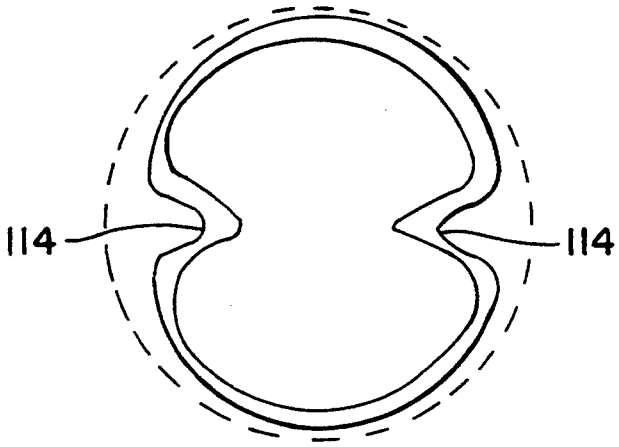

Lower shearing ram 54 includes body 90 having rear slot 92 for engagement with connecting rod 26, groove 94 for receiving top seal 40, side recesses 96 for receiving side packers 98 (FIG. 13) and forwardly extending shearing blade 100 having a cutting edge 102 at its upper front portion with flat surface 104 extending rearwardly therefrom. Flat surface 104 ends in wall 106 which extends upward to the upper surface of body 90 as shown in FIG. 8. The forward portion of upper shear blade 100 includes a central tapered conical recess 108 extending upward and of increasing diameter in the downward direction and a flaring taper 110 extending to the side of blade 100 from the conical recess 108. Recesses 112 are formed under blade 100 on each side and at its sides blade 100 has a preselected thickness so that it will fit tightly into the space between lower flat surface 70 of upper blade 66 and surface 80 at each side of opening 82. In this manner, blade 100 is supported during shearing so that it does not twist or turn. This ensures that the units will easily and quickly shear a wire line extending through the bore 14 of the blowout preventer 10 having the improved shearing rams therein, even when the wire line is not under tension. As can be seen from FIG. 6, the sides of tapered conical surface 108 are tapered at 30° adjacent the cutting edge of lower blade and 15° at its lower edge. Similar tapers are provided in tapered conical recess 84 in upper blade. These ramps or tapers leading to the recesses allow tubing of larger sizes to be accommodated and causes the tubing to be centered in the recesses to ensure that it is forced wholly into the recesses and is not flattened during the shearing.

Also, when the improved shear rams 52 and 54 of the present invention shear a string of production tubing, they will cause the upper end of the lower sheared fish to be formed into an opening having a FIG. 8 shape. This is because of the tapered conical opening 108 in lower blade and in the tapered conical opening 88 in upper blade 66. This is demonstrated in FIG. 8A and 8B wherein FIG. 8A shows the rounded tubular cross section of a tubing string before shearing and FIG. 8B shows the upper end of the lower fish after it has been sheared. The sides of the tubing having been forced inwardly as at 114 and this prevents the tubing from flattening out to a dimension much greater than its original diameter. Also, this allows a very substantial opening as shown in FIG. 8B and also in FIG. 11.

Requirements of customers who wish to have a tubing shearing ram include that a minimum of 30% of the original flow area inside the tubing be maintained and that the final outside diameter of the lower portion of the sheared tubing be less than or equal to the original diameter of the tubing. The crimping of the tubing during shearing eliminates the need for an additional trip downhole to prepare the lower portion of the sheared tubing for an overshot tool and eliminates the need to change out shear blades for each specific tubing size.

The improved shearing rams of the present invention can handle a variety of sizes of tubing strings, with the samples which have been sheared by the improved shear rams of the present invention running in sizes from 1.75" to 2" to 2.38" with all of the tubing being maintained with a minimum dimension across the shear and having a top opening which is sufficient for circulation therein by an overshot.

The upper and lower shearing rams are also shown in the perspective views of FIGS. 11 to 21.

Figure 11:
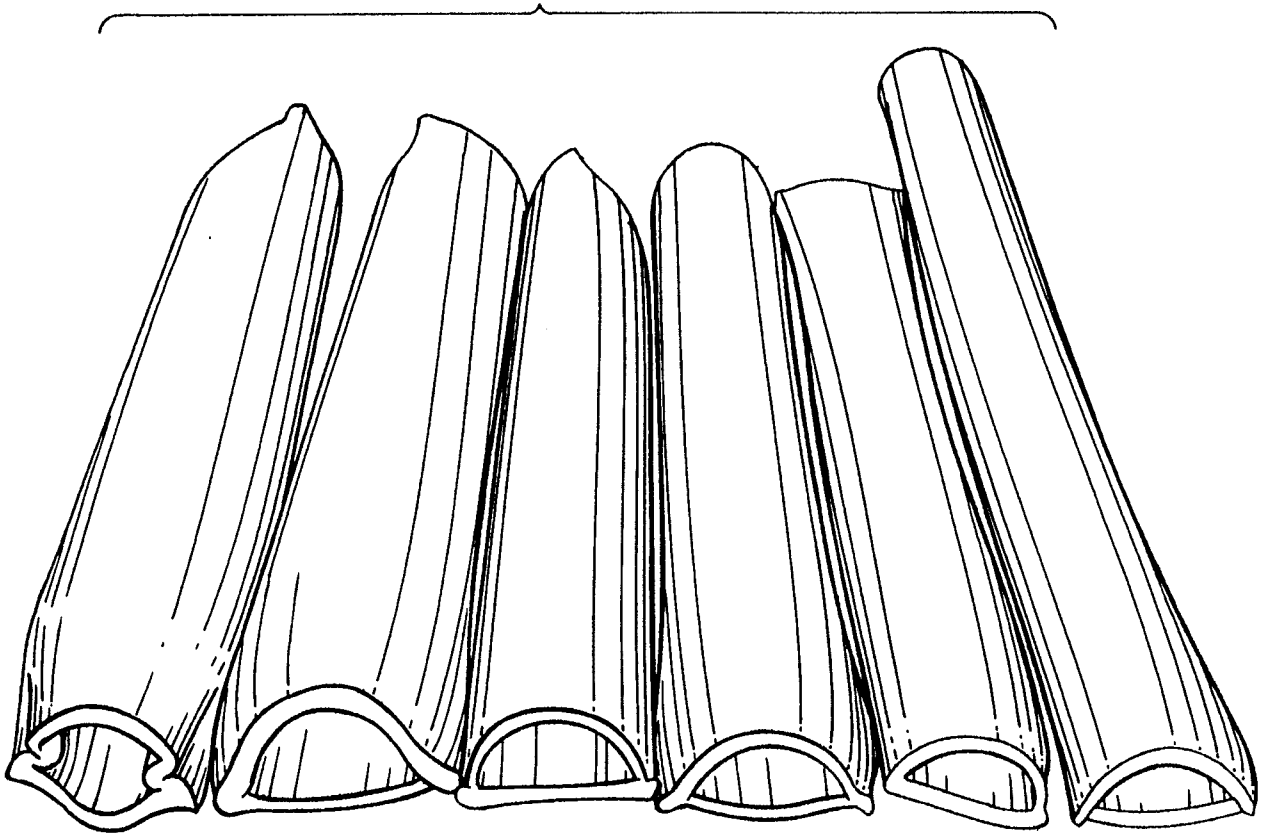
FIG. 11 is a perspective drawing of different sizes of the upper end of the lower portion of tubing strings after they had been sheared by the same improved shearing rams of the present invention.

FIG. 11 is a perspective top view of the upper ram.

Figure 12:
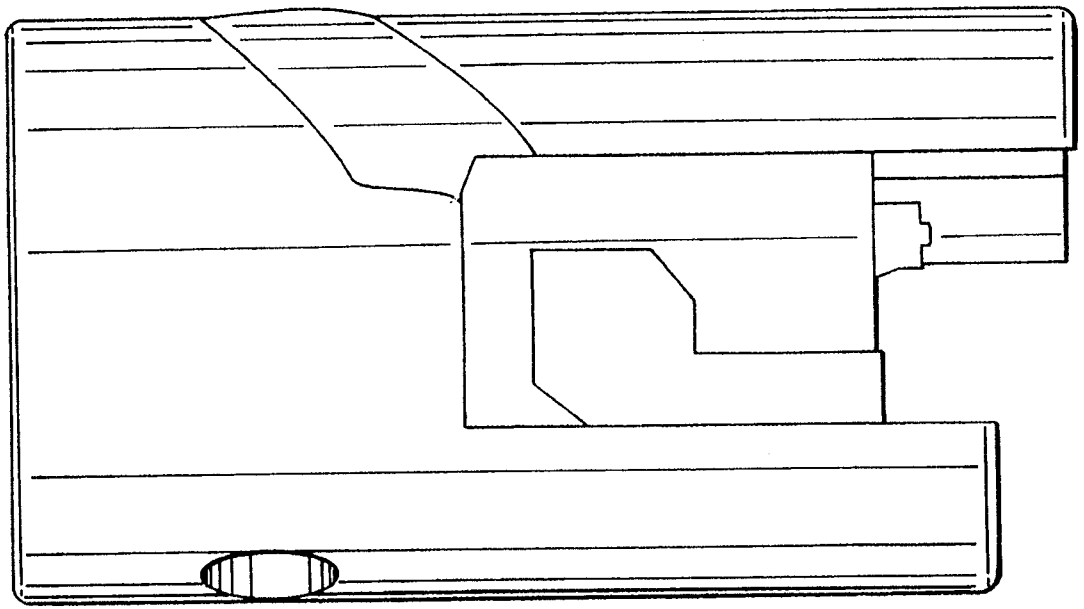
FIG. 12 is a side view of the improved upper shear ram of the present invention to illustrate the top seal, the side seal and the seal under the upper shear blade.

FIG. 12 is a perspective bottom view of the upper ram.

Figure 13:
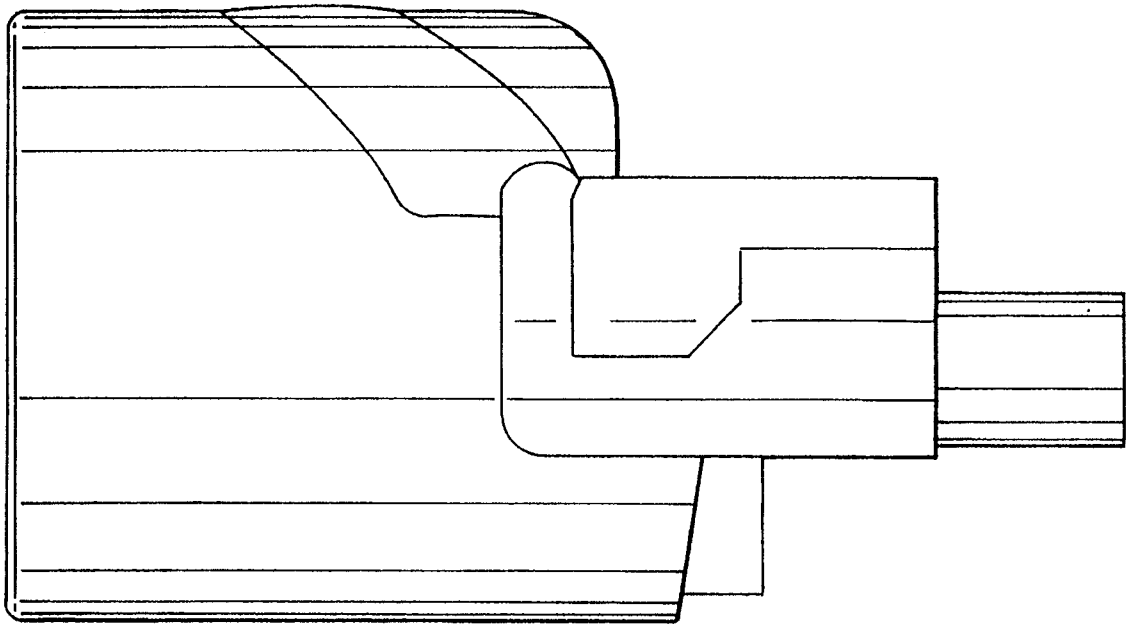
FIG. 13 is a side view of the improved lower shear ram of the present invention to illustrate the top seal, and the side seal.

FIG. 13 is a perspective front view of the upper ram.

What is claimed is:

1. A blowout preventer comprising a body having a central bore therethrough and a pair of opposed guideways extending outwardly from the bore, a ram in each of said guideways, means for moving said rams in said guideways to cause them to move into said bore, in use to shear tubing in the bore, and to withdraw from said bore, each of said rams having coacting upper and lower shear blades, one of said blades being the upper shear blade and the other being the lower shear blade, the ram with the upper shear blade having a front shearing edge and a flat surface extending rearwardly therefrom and terminating in a wall, a recess in said upper shear blade flat surface, a tapered conical recess in the upper shear blade above said flat surface, and a tapered conical recess in the upper shear blade below said flat surface, the ram with the lower shear blade having its forward cutting edge positioned to pass immediately under said flat surface on said upper shear blade when said rams are moved together, and a flat surface extending rearwardly from its cutting edge to provide a sealing surface, a tapered conical recess in said blade extending below said sealing surface, sealing means positioned in the recess on said upper shear blade flat surface for sealing against the flat surface n said lower shear blade, and said conical recesses in said shear rams being sized and positioned to coact to engage a tubular member extending through said body bore to cause the upper end of the tubular member after shearing to have a substantial opening therein and to be no larger in its exterior dimension transversely of the rams than a preselected maximum dimension.

2. A blowout preventer according to claim 1 wherein said tapered conical recesses are sized to receive a plurality of sizes of tubing therein after shearing to maintain a horizontal transverse dimension and an upper opening to allow direct engagement by an overshot.

3. A blowout preventer according to claim 2 including tapered surfaces on each side of each of said tapered recesses to allow large size tubing robe received therein.

4. A blowout preventer according to claim 1 including a pair of surfaces on said upper shear ram spaced horizontally apart and lying in a plane parallel to and spaced below said upper blade flat surface a distance allowing entry of said lower shear blade between said flat surface and said pair of surfaces, said pair of surfaces being sufficiently close to said upper blade flat surface for supporting said lower shear blade sufficiently so that it will shear a wire line extending between the shear blades even when not under tension.

5. A blowout preventer according to claim 1 including flared surfaces on each side of each of the tapered conical recesses.

* * * * *